US008284952B2

(12) United States Patent
Reining et al.

(10) Patent No.: US 8,284,952 B2
(45) Date of Patent: Oct. 9, 2012

(54) MODELING OF A MICROPHONE

(75) Inventors: Friedrich Reining, Vienna (AT); Hannes Breitschädel, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 1210 days.

(21) Appl. No.: 11/472,801

(22) Filed: Jun. 21, 2006

(65) Prior Publication Data

US 2007/0009115 A1 Jan. 11, 2007

(30) Foreign Application Priority Data

Jun. 23, 2005 (EP) ..... 05450111

(51) Int. Cl.
*H04R 3/00* (2006.01)

(52) U.S. Cl. ..... 381/92; 381/122; 381/94.1; 381/97; 381/111

(58) Field of Classification Search ..... 381/92, 381/66, 94.1, 94.7, 89, 90, 97, 182, 188, 381/205, 111, 122; 367/131, 119, 129; 181/153, 181/158, 171, 179, 198
See application file for complete search history.

(56) References Cited

U.S. PATENT DOCUMENTS

| | | | | |
|---|---|---|---|---|
| 4,042,779 | A * | 8/1977 | Craven et al. | 381/103 |
| 5,377,166 | A * | 12/1994 | Kuhn | 367/138 |
| 2003/0215106 | A1 * | 11/2003 | Hagen et al. | 381/313 |
| 2005/0123149 | A1 * | 6/2005 | Elko et al. | 381/92 |

FOREIGN PATENT DOCUMENTS

EP 0869697 A2 10/1998

OTHER PUBLICATIONS

Jens, Meyer; Beamforming for a circular microphone array mounted on spherically shaped objects; Journal of the Acoustical Society of America, American Institute of Physics, New York, US; vol. 109, No. 1, Jan. 2001; pp. 185-193.

* cited by examiner

*Primary Examiner* — Vivian Chin
*Assistant Examiner* — Leshui Zhang

(57) ABSTRACT

A system that models a microphone may include capsules that receive individual signals. The signals may be combined and modified based on a weighting factor. Directivity patterns of a converted signal may be modified or controlled based on the weighting of the signals.

28 Claims, 6 Drawing Sheets

MODELING OF A MICROPHONE

BACKGROUND OF THE INVENTION

1. Priority Claim

This application claims the benefit of priority from European Application No. 054501119, filed Jun. 23, 2005, which is incorporated by reference.

2. Technical Field

This application relates to the modeling of signals received by devices that convert sound waves into analog or digital signals.

RELATED ART

A microphone may include individual capsules that receive audio signals. Each capsule receives an audio signal. The capsules may be positioned in directivity patterns. A microphone may receive signals in an ominidirectional, cardioid, or figure-eight directivity pattern.

A directivity pattern may deviate from ideal directional behavior of sound transmitted from an audio source, which may reduce the sound quality detected by the microphone. Some systems attempt to model deviations by combining or modifying directivity patterns. However, such models may require mechanical design changes and the desired directivity pattern may not be rotationally symmetric. Other systems may equalize the signals from the microphone capsules. However, sound pattern equalization may be based only on theoretical considerations rather than real world sound patterns. Therefore, a need exists for an improved system for modeling a microphone.

SUMMARY

A system that models a microphone may include capsules that receive individual signals. The signals may be combined and modified based on a weighting factor. Directivity patterns of a converted signal may be modified or controlled based on the weighting of the signals.

Some systems provides arbitrary synthesized directivity patterns that are generated by the equalization of signals. The directivity pattern may be adjusted to different frequencies that simulate a microphone. The directivity pattern may be rotated in some or all spatial directions. A microphone response may be measured from different spatial directions and optionally at different frequencies. A directivity factor may be determined for at least one spatial region from the measurement data and compared with a predetermined value. Depending on the deviation of the directivity factor from the predetermined value, the weighting factors may be altered until the directivity factor substantially equals the predetermined value, or lies within specific limits.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention.

Moreover, in the figures, like referenced numerals designate corresponding parts throughout the different views.

DETAILED DESCRIPTION OF THE PREFERRED EMBODIMENTS

Figure 1:
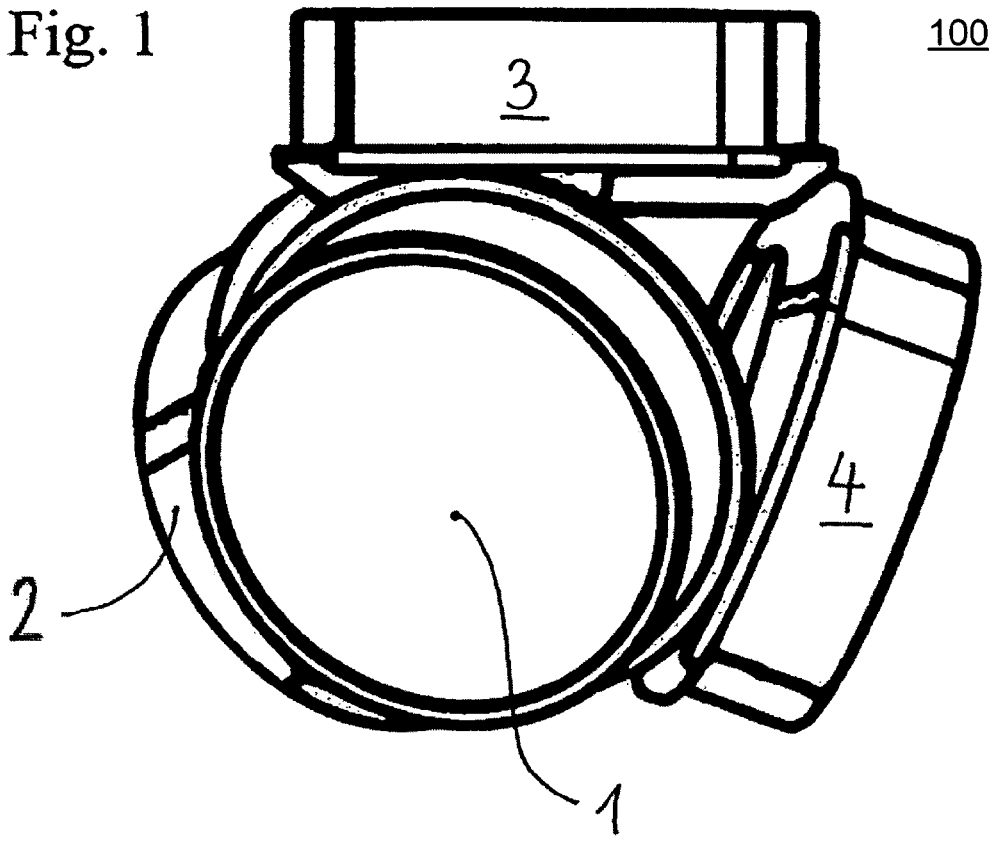
FIG. 1 is a diagram a device that converts sound into analog or digital signals.

FIG. 1 is a diagram of a microphone 100. The microphone 100 may combine a device that converts sound into analog or digital signals, that may be sent into a second device, such as an amplifier, a recorder, or a broadcast transmitter. The microphone 100 of FIG. 1 is shown with four capsules 1, 2, 3, and 4 arranged on a substantially spherical surface. In this system, the membranes of the capsules are almost parallel to the sides of a tetrahedron, which comprises a four-sided polygon in the shape of a pyramid. As shown, there is a capsule located on each of the four faces. In other systems, a microphone may have more or less capsules positioned in other arrangements. A capsule includes a transducer, which contains the structure that converts acoustic sound waves into analog or digital signals. In FIG. 1, the microphone 100 has four pressure-gradient capsules arranged on the surface. The number and the arrangement of capsules may affect the directivity pattern of the microphone.

Figure 2:
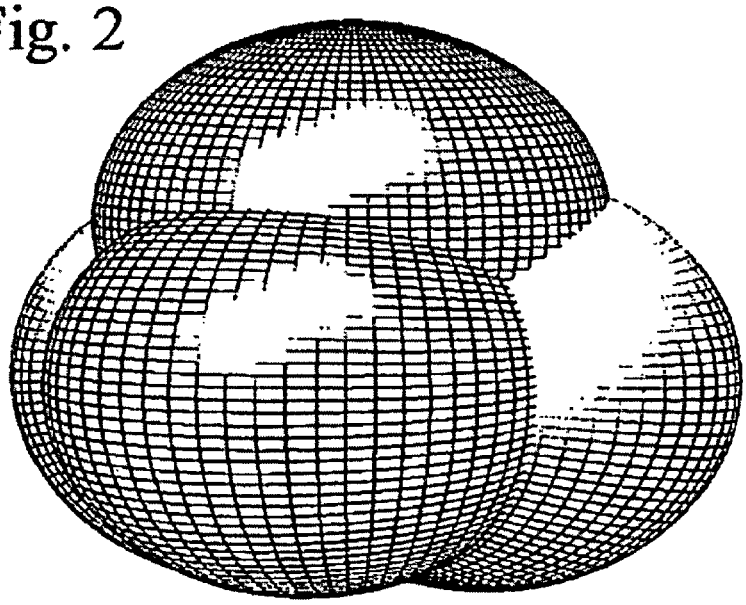
FIG. 2 is a diagram of a directivity pattern.

One example of the directivity patterns of the capsule signals is shown in FIG. 2. A directivity pattern may refer to the directivity pattern of real capsules, and may refer to the orientation of signals in other devices. These signals may include other signals that may have complicated directivity patterns. The expression directivity pattern may establish from which spatial regions a forming or synthesized signal preferably furnishes acoustic information.

Five directivity patterns comprise cardioid, supercardioid, hypercardioid, ominidirectional, and figure-eight. Cardioid may have a high sensitivity near the front of a microphone and good sensitivity near its sides. The cardioid pattern has a "heart-shaped" pattern. Supercardioid and hypercardioid are similar to the cardioid pattern, except they may also be subject to sensitivity behind the microphone. Omnidirectional receives sound almost equally from all directions relative to the microphone. A figure-eight may be almost equally sensitive to sound in the front and the back ends of the microphone, but may not be sensitive to sound received near the sides of the microphone.

The directivity patterns may be obtained by combining two capsule signals, for example, the addition of an ominidirectional and a figure-eight to a cardioid. In this combination, the amplitude of both signals may be equally large. By weighting the omnidirectional and figure-eight signal, the resulting directivity pattern may be adjusted between an omnidirectional and a figure-eight pattern, for example from a cardioid to a hypercardioid pattern. The frequency response of the omnidirectional and figure-eight signal may be adjusted separately before the signals are combined. By influencing the frequency response of the individual signals, the frequency response and directivity pattern of the signal produced by addition may be arbitrarily modeled. An exemplary adaptation is described in DE 44 36 272 A1, which is incorporated by reference.

Figure 3:
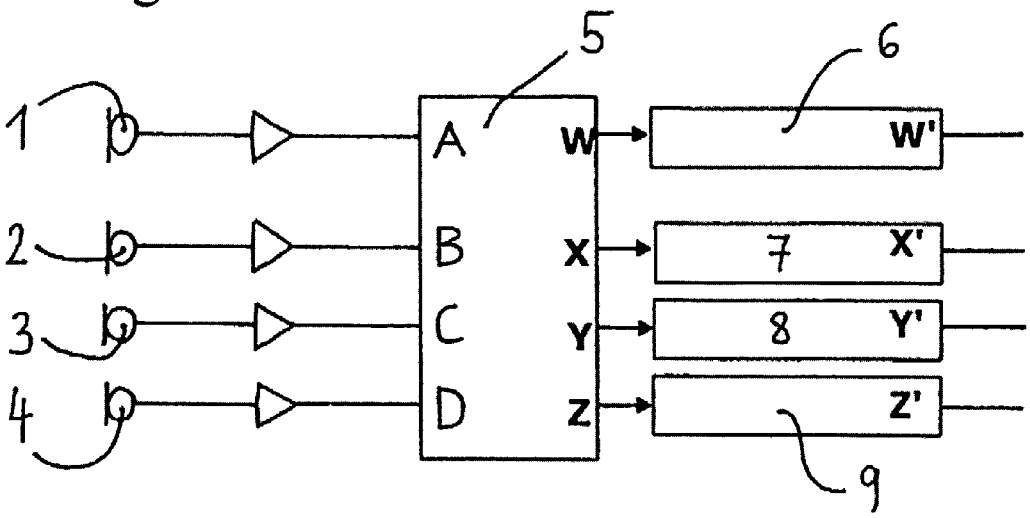
FIG. 3 is a block diagram of an interface linked to a microphone.

FIG. 3 shows a block diagram of the signals paths in a microphone. The signals or capsules 1, 2, 3, and 4 of a sound field microphone (A, B, C, and D) are converted into a B format (W, X, Y, and Z) in matrix 5. The inputs 1, 2, 3, 4 may correspond to the four capsules shown in FIG. 1. The sound field microphone or B format microphone may include four pressure-gradient capsules in which the individual capsules are arranged in a tetrahedron like shape as in FIG. 1. Each of the individual capsules may deliver its signal 1, 2, 3, or 4, respectively. Each individual pressure receiver may include a directivity pattern deviating from omnidirectional and may approximately be represented by an expression such as $(1-k)+k\times\cos(\theta)$, in which $\theta$ comprises the azimuth angle under which the capsule is exposed to sound and the ratio factor k designates how strongly the signal deviates from an omnidirectional signal. For example, in a sphere, k=0, and in a figure-eight, k=1. The signals of the individual capsules may be denoted A, B, C, and D as shown in FIG. 3. The axis of symmetry of the directivity pattern of each individual microphone may be substantially perpendicular to the corresponding face of the tetrahedron. The axes of symmetry of the directivity pattern of each individual capsule (also referred to as the main direction of the individual capsule) together may enclose an angle of about 109.5°.

The four individual capsule signals may be converted to the B format (W, X, Y, Z) by the following:

$$W=\tfrac{1}{2}(A+B+C+D) \quad \text{(Equation 1)}$$

$$X=\tfrac{1}{2}(A+B-C-D) \quad \text{(Equation 2)}$$

$$Y=\tfrac{1}{2}(-A+B+C-D) \quad \text{(Equation 3)}$$

$$Z=\tfrac{1}{2}(-A+B-C+D) \quad \text{(Equation 4)}$$

Figure 4:
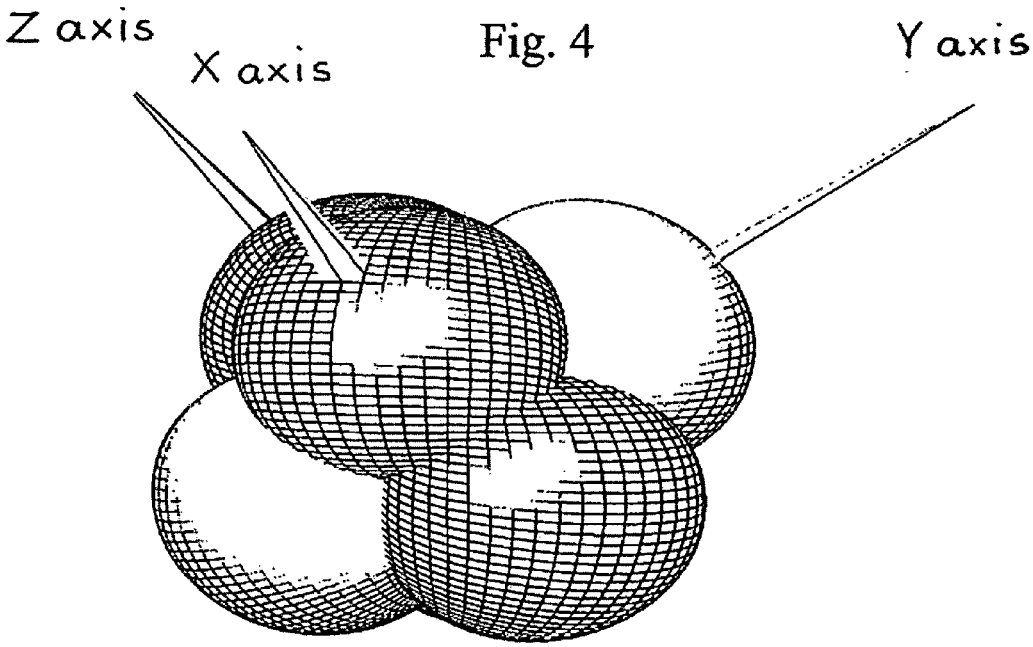
FIG. 4 is another diagram of a directivity pattern.

The forming signals of the B format include one sphere (W) and three figure-eights (X, Y, Z) orthogonal to each other. As shown in FIG. 3, the inputs are converted by matrix 5 into W', X', Y', and Z', numbered 6-9. There are three figure-eights arranged along the three spatial directions as shown in FIG. 4. FIG. 4 shows another directivity pattern, which is similar to that in FIG. 2, except the lobes/directions of the B format are shown. The main directions of the figure-eight are substantially normal with respect to the sides of a cube enclosing the tetrahedron. An exemplary adaptation of this approach is described in U.S. Pat. No. 4,042,779 (corresponding DE 25 31 161 C1), each of which are incorporated by reference.

In FIG. 3, corresponding amplifiers are connected to the capsules and the matrix. In addition, filters 6, 7, 8, and 9 ensure equalization of the B format signals. The frequency and phase response for all directions may be configured to equalize the signals W, X, Y, Z. For the zero order signal (W) and the first-order signals (X, Y, Z), equalization may depend on the frequency and effective spacing between the center of the microphone capsules and the center of the tetrahedron. Other equalization formulas are described in *The Design of Precisely Coincident Microphone Arrays for Stereo and Surround Sound*, by Michael A. Gerzon which was presented in 1975 at the 50th convention of the Audio Engineering Society Proceedings, which is incorporated by reference.

Through linear combination of at least two of the B format signals, a microphone capsule may be synthesized or modeled. In one system, synthesizing or modeling of the microphone may occur by combining the omnidirectional signal (W) with one or more of the figure-eight signals (X, Y, Z). A linear weighting factor k may be used, such that the model comprises $W+k\times X$.

Directivity patterns in a range between an omnidirectional and a cardioid, may produce a synthesized capsule in the X direction as described by the formula $K=W+k\times X$, in which k may assume a value greater than 0 in one system. The level of the signal K may be substantially normalized so that the desired frequency is produced for the main direction of the synthesized capsule. If a synthesized capsule is viewed in any direction, additional weighting factors may be determined, since rotation of the synthesized capsule in any direction may occur through a linear combination of three orthogonal figure-eights (X, Y, Z).

Some models may include artifacts based on the actual structure of the microphone. Artifacts may be audible differences between a compressed signal and the original signal. A set of parameters for the ratio of the omnidirectional signal to the figure-eight signal, and also the ratio of individual figure-eight signals, may be calculated for each direction for which modeling of the capsule occurs. It may then be implicitly assumed that the directivity patterns of the individual figure-eight signals (X, Y, Z) differ from each other. This may occur, for example, if one of the four real capsules differs from the other three capsules. If one of the figure-eight signals is not correct, in this situation, the synthesis of that capsule signals may lead to a defective model.

It may be possible to produce four capsules that differ in frequency response and directivity pattern only to an extent that is much smaller than the differences between theory and practice based on the use of real capsules and their arrangement. The differences of the individual capsules relative to each other may be negligibly small. Consequently, it is sufficient to investigate the ratio between the omnidirectional signal and an arbitrary signal selected from the figure-eight signals using the above formula.

A predictable directivity pattern for the microphone may be attained if the amplitudes of the individual B format signals are equally large or are known in relation to one other. Based on the frequency dependence of the individual capsule directivity patterns, the amplitudes of the individual B format signals may deviate from an ideal value. This deviation may be frequency-dependent.

Figure 5:
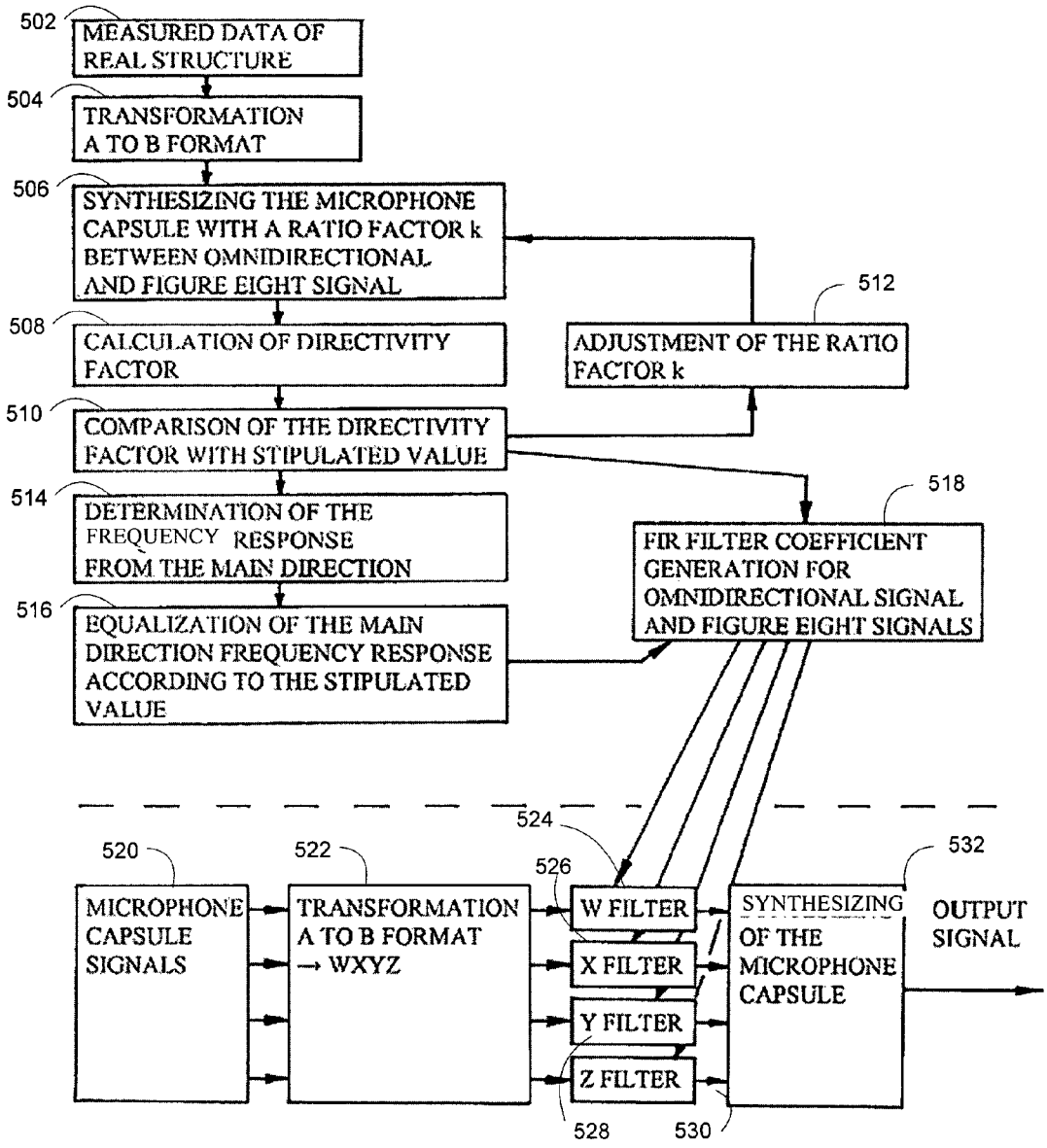
FIG. 5 is a flowchart modeling a microphone.

FIG. 5 is a flowchart of modeling a microphone processing. In act 502, the measured data of the microphone may be determined. The measurement may account for all directions and frequencies. In one example, a sound source emitting a test signal is rotated in spatial intervals, for example, almost every 5° or almost every 10° around the microphone, so that a signal may be measured from all spatial directions. This measurement may occur at different frequencies or frequency ranges. In act 504, microphone capsules are modeled. B format signals are determined from the individual capsule signals according to the measurements. The measurements may be compared with one another to achieve specific directivity patterns. In act 506, a specific weighting factor k between the omnidirectional and figure-eight signal may be calculated. In act 508, the directivity factor $\gamma$ may be calculated for the overall signal resulting from the combination/synthesis.

$$\gamma=\frac{4\pi}{\int_0^{2\pi}\int_{-\pi/2}^{\pi/2}|M(\theta,\phi)|^2\cos(\phi)\,d\phi\,d\theta} \quad \text{(Equation 5)}$$

Equation 5 is one example of a calculation of the directivity factor $\gamma$. The directivity factor $\gamma$ may be used to characterize the obtained directivity pattern. $M(\theta,\phi)$ may be called the "directional effect function" or "sensitivity". The directivity factor for an electro-acoustic transducer for sound reception, at a specified frequency, may comprise the ratio of the square of the free-field sensitivity to sound waves that arrive along the principal axis, to the mean-square sensitivity to a succession of sound waves that arrive at the transducer with equal probability from all directions.

Different methods that calculate the directivity factor may also be used. For example, prefactors, normalizations, and integration or summation limits may be varied in Equation 5. For some directivity patterns, the following values were obtained for the directivity factor y according to Equation 5:

Sphere=1

Cardioid=3

Supercardioid=3.73

Hypercardioid=4

Figure-eight=3

During measurement of a sound field or B format microphone, the sensitivity M for the modeled microphone may be determined for each position of a test sound source. The sensitivity M for a certain test arrangement/direction may correspond to the amplitude of the signal modeled by the calculation method and in combination with reference to the amplitude occurring during sound incidence proceeding from the main direction as in act 514. This essentially acts as a normalization/equalization function as in act 516 because the sensitivity from the main direction is therefore about 1 dB or almost 0 dB. From the discrete measured data for sensitivity M, the directivity factor $\gamma$ may be determined for each measured frequency. Either the integral can be replaced by a summation or the measured values can be interpolated to a function $M(\theta,\phi)$.

In act 510, the directivity factor may be compared with a stipulated value. If the directivity factor agrees with the predetermined or stipulated value, the weighting factor k between two signals being combined remains unchanged at act 514. However, if the directivity factor $\gamma$ deviates from the stipulated value, the weighting factor k may be adjusted at act 512. Acts 506-510 may be repeated until the determined directivity factor substantially agrees with the predetermined or stipulated value or is within predetermined limits.

In act 518, weighting factor k may be the basis for the coefficients used for the individual B format signals in the W, X, Y, Z filters 524-530. The filters 524-530 may filter the data using a weighting factor k for the coefficients that are added to the B format signals. The coefficients may be determined for each frequency or each frequency range and may be extrapolated to a continuous frequency-dependent function. At act 520 the microphone capsule signals are transferred, and at act 522, are transformed into B format (W, X, Y, Z). The coefficients are used for the W, X, Y, and Z filters for synthesizing of the microphone capsule in act 532.

The method of FIG. 5 may be encoded in a signal bearing medium, a computer readable medium such as a memory, programmed within a device such as one or more integrated circuits, one or more processors or processed by a controller or a computer. If the methods are performed by software, the software may reside in a memory resident to or interfaced to a storage device, synchronizer, a communication interface, or non-volatile or volatile memory in communication with a transmitter. A circuit or electronic device designed to send data to another location. The memory may include an ordered listing of executable instructions for implementing logical functions. A logical function or any system element described may be implemented through optic circuitry, digital circuitry, through source code, through analog circuitry, through an analog source such as an analog electrical, audio, or video signal or a combination. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine readable medium," "propagated-signal" medium, and/or "signal-bearing medium" may comprise any device that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM" (electronic), a Read-Only Memory "ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

Figure 6:
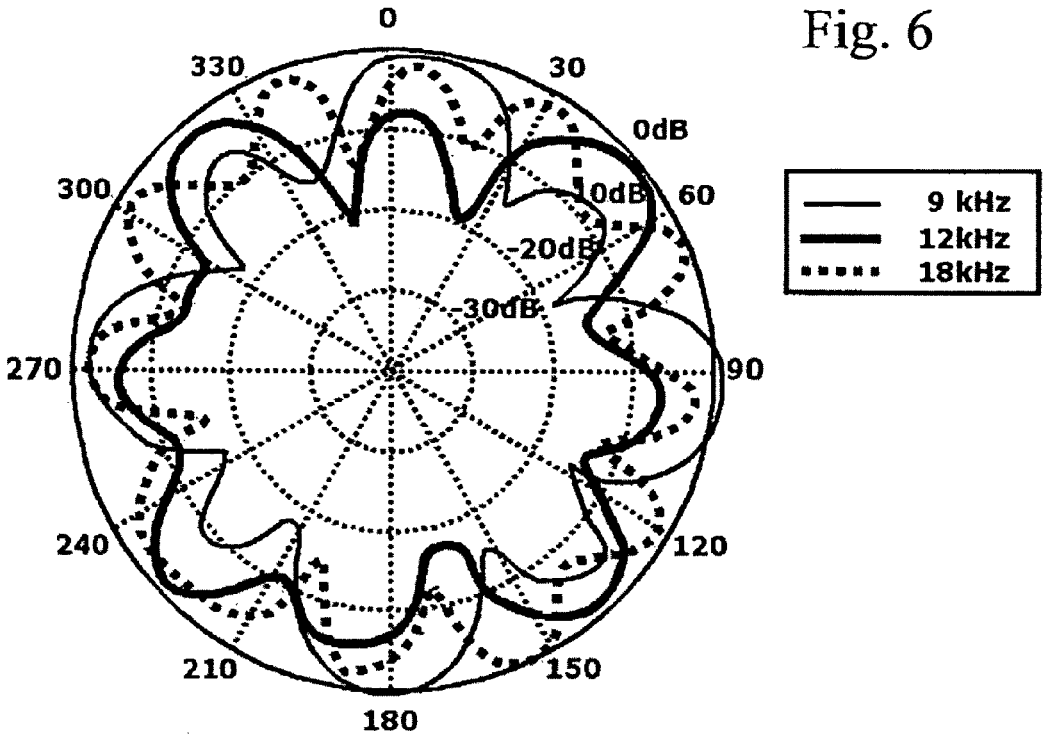
FIG. 6 is a diagram of a directivity pattern.
Figure 7:
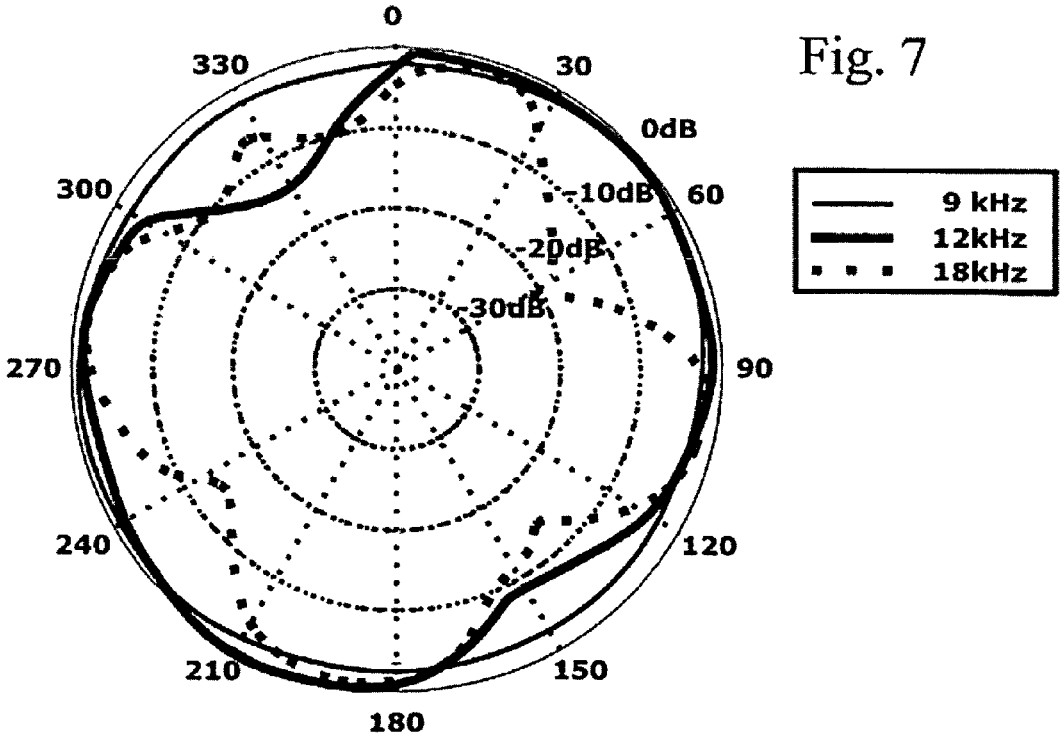
FIG. 7 is diagram of another directivity pattern.

In theory spherical harmonic functions may result in accurate calculations, but in practice deviations and artifacts may be produced having magnitudes dependent on the spacing of the individual capsules from each other, as shown in FIGS. 6 and 7. FIG. 6 is a directivity pattern with greater spacing between capsules than the directivity pattern shown in FIG. 7. Specifically, FIG. 6 is a polar diagram of the omnidirectional signal for a tetrahedral capsule arrangement with a roughly 25 mm capsule spacing. FIG. 7 is the polar diagram of the omnidirectional signal for a tetrahedral capsule arrangement with a roughly 12 mm capsule spacing.

The artifacts may not be compensated for by means of linear equalization formulas. Considering the omnidirectional signal (W) as is apparent in FIG. 6, the deficient coincidence results in an angle dependence (for example azimuth) of the omnidirectional signal. An ideal omnidirectional signal will be independent of the sound incidence angle, however, FIG. 6 shows that at various angles, the sound measurement may be reduced. FIG. 7 is a similar directivity pattern, but with individual capsules have a much smaller spacing from each other than in FIG. 6. FIG. 7 shows a decrease in distortion for all frequencies as a result of the location of the capsules relative to one another. By reducing the capsule spacing the artifacts may be shifted to higher frequencies. An equalization filter may not equalize the omnidirectional signal without consideration of the sound incidence angle. In the context of these deviations, however, the signals may be described or approximated with spherical harmonics.

FIG. 5 represents an example modeling a microphone. Additional systems may include additional, fewer, or modified acts. The system may be used with microphones containing capsules in which signals combined from the individual capsule signals may be generated, whose directivity pattern may be described by spherical harmonics. Spherical harmonics comprise the angular portion of an orthogonal set of solutions to Laplace's equation. For example, $W(r, \phi, \phi)$ may be substantially equal to 1 for a zero order spherically harmonic signal in spherical coordinates and $X(r, \phi, \theta)$ may be substantially equal to $\cos(\phi)$ for one of the three first-order spherical harmonic signals. However, the spherical harmonics according to this system are not restricted to the zero and first order. By corresponding the number and arrangement of capsules, the sound field may also be represented by second and even higher order spherical harmonics.

B format signals may be orthogonal to each other. The sound field may therefore be split up by sound field microphones into components substantially orthogonal to each other. This substantial orthogonality may permit a differentiated representation of the sound field so that two or more optionally weighted B format signals may be deliberately combined to form a microphone signal with the desired directivity pattern. Separation of the sound field into B format signals that additionally include second-order spherical harmonics may permit an even more differentiated representation of the sound field and even higher spatial resolution. A second-order sound field microphone is considered and described in the dissertation *On the Theory of the Second-Order Sound Field Microphone*, by Philip S. Cotterell, BSc, MSc, AMIEE, Department of Cybernetics, February 2002, which is incorporated by reference.

Figure 8:
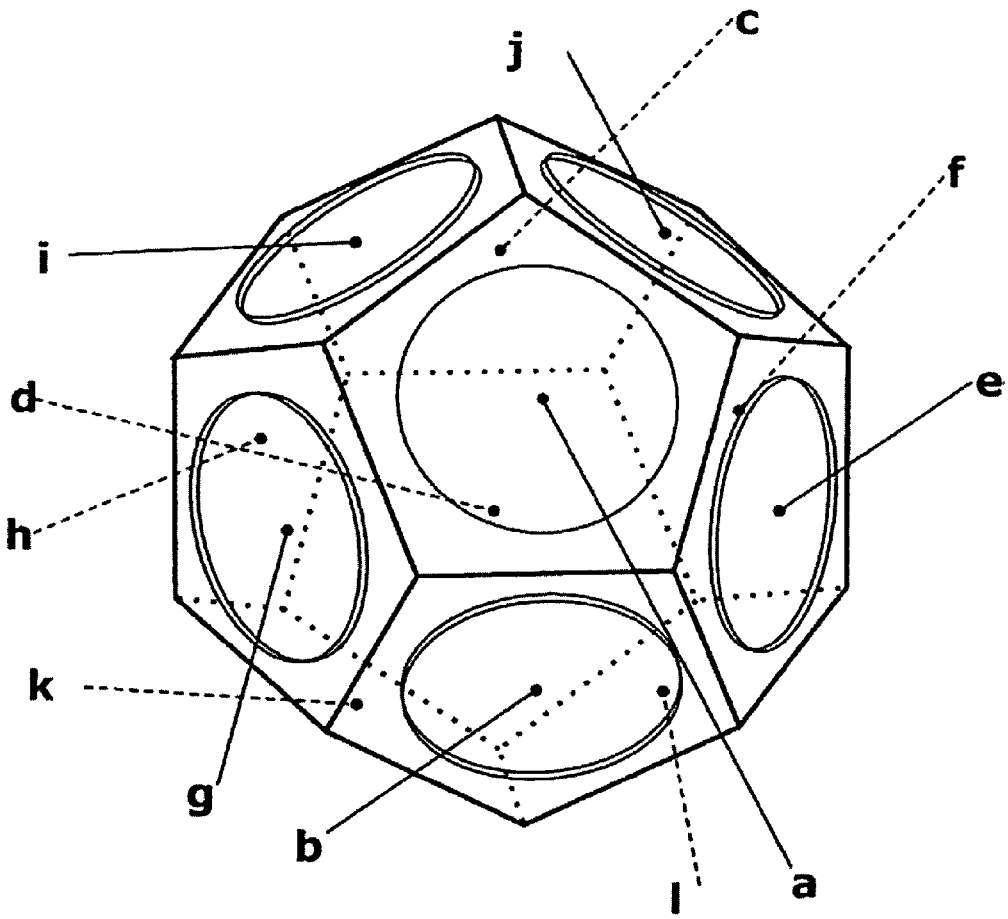
FIG. 8 is another diagram of a microphone.

A sound field microphone that can image the spherical harmonics up to the second order may include, for example, about 12 individual gradient microphone capsules. In FIG. 8, the microphone capsules are arranged in the form of a dodecahedron in which each face includes a capsule. The numbering of the capsules begins on the front side of the top with "a" and ends at the right bottom with "1". In a Cartesian coordinate system, the normal vectors of the individual capsules may be defined as follows.

If two auxiliary quantities are introduced:

$$\chi^{+} = \sqrt{\frac{1}{10}}\sqrt{5+\sqrt{5}} = \frac{1}{10}\sqrt{50+10\sqrt{5}} \quad \text{(Equation 6)}$$

$$\chi^{-} = \sqrt{\frac{1}{10}}\sqrt{5-\sqrt{5}} = \frac{1}{10}\sqrt{50-10\sqrt{5}} \quad \text{(Equation 7)}$$

The normal vectors $\hat{u}$ may be written:

$\hat{u}_{_1}=[\chi^{+}0\chi^{-}]^{T}$ $\hat{u}_{_2}=[\chi^{+}0\chi^{-}]^{T}$ $\hat{u}_{_3}=[-\chi^{+}0\chi^{-}]^{T}$ $\hat{u}_{_4}=[-\chi^{+}0-\chi^{-}]^{T}$ $\hat{u}_{_5}=[\chi^{-}\chi^{+}0]^{T}$ $\hat{u}_{_6}=[-\chi^{-}\chi^{+}0]^{T}$ $\hat{u}_{_7}=[\chi^{-}-\chi^{+}0]^{T}$ $\hat{u}_{_8}=[-\chi^{-}-\chi^{+}0]^{T}$ $\hat{u}_{_9}=[0\chi^{-}\chi^{+}]^{T}$ $\hat{u}_{_10}=[0-\chi^{-}\chi^{+}]^{T}$ $\hat{u}_{_11}=[0\chi^{-}-\chi^{+}]^{T}$ $\hat{u}_{_12}=[0-\chi^{-}-\chi^{+}]^{T}$ The B format with the known zero and first-order signals W, X, Y, Z may be expanded by additional signals corresponding to the second-order spherical signal components. The five signals are denoted with the letters R, S, T, U, and V. The relations between the capsules signals s1, s1 . . . s12 with the corresponding signals W, X, Y, Z, R, S, T, U, and V are shown in the following table:

TABLE 1

| | W | X | Y | Z | R | S | T | U | V |
|---|---|---|---|---|---|---|---|---|---|
| s1 | $\frac{1}{12}$ | $\frac{1}{4}x^{+}$ | 0 | $\frac{1}{4}x^{-}$ | $\frac{1}{4}x\frac{\sqrt{5}}{48}(\sqrt{5}-3)$ | $\frac{\sqrt{5}}{6}$ | 0 | $\frac{\sqrt{5}}{24}(1+\sqrt{5})$ | 0 |
| s2 | $\frac{1}{12}$ | $\frac{1}{4}x^{+}$ | 0 | $-\frac{1}{4}x^{-}$ | $\frac{\sqrt{5}}{48}(\sqrt{5}-3)$ | $\frac{\sqrt{5}}{6}$ | 0 | $\frac{\sqrt{5}}{24}(1+\sqrt{5})$ | 0 |
| s3 | $\frac{1}{12}$ | $-\frac{1}{4}x^{+}$ | 0 | $\frac{1}{4}x^{-}$ | $\frac{\sqrt{5}}{48}(\sqrt{5}-3)$ | $\frac{\sqrt{5}}{6}$ | 0 | $\frac{\sqrt{5}}{24}(1+\sqrt{5})$ | 0 |
| s4 | $\frac{1}{12}$ | $-\frac{1}{4}x^{+}$ | 0 | $-\frac{1}{4}x^{-}$ | $\frac{\sqrt{5}}{48}(\sqrt{5}-3)$ | $\frac{\sqrt{5}}{6}$ | 0 | $\frac{\sqrt{5}}{24}(1+\sqrt{5})$ | 0 |
| s5 | $\frac{1}{12}$ | $\frac{1}{4}x^{-}$ | $\frac{1}{4}x^{-}$ | 0 | $-\frac{5}{24}$ | 0 | 0 | $-\frac{\sqrt{5}}{12}$ | $\frac{\sqrt{5}}{6}$ |
| s6 | $\frac{1}{12}$ | $-\frac{1}{4}x^{-}$ | $-\frac{1}{4}x^{-}$ | 0 | $-\frac{5}{24}$ | 0 | 0 | $-\frac{\sqrt{5}}{12}$ | $\frac{\sqrt{5}}{6}$ |
| s7 | $\frac{1}{12}$ | $\frac{1}{4}x^{-}$ | $-\frac{1}{4}x^{-}$ | 0 | $-\frac{5}{24}$ | 0 | 0 | $-\frac{\sqrt{5}}{12}$ | $\frac{\sqrt{5}}{6}$ |
| s8 | $\frac{1}{12}$ | $-\frac{1}{4}x^{-}$ | $-\frac{1}{4}x^{-}$ | 0 | $-\frac{5}{24}$ | 0 | 0 | $-\frac{\sqrt{5}}{12}$ | $\frac{\sqrt{5}}{6}$ |
| s9 | $\frac{1}{12}$ | 0 | $\frac{1}{4}x^{-}$ | $\frac{1}{4}x^{+}$ | $\frac{\sqrt{5}}{48}(\sqrt{5}+3)$ | 0 | $\frac{\sqrt{5}}{6}$ | $\frac{\sqrt{5}}{24}(1+\sqrt{5})$ | 0 |

TABLE 1-continued

| | W | X | Y | Z | R | S | T | U | V |
|---|---|---|---|---|---|---|---|---|---|
| s10 | $\frac{1}{12}$ | 0 | $-\frac{1}{4}X^-$ | $\frac{1}{4}X^+$ | $\frac{\sqrt{5}}{48}(\sqrt{5}+3)$ | 0 | $-\frac{\sqrt{5}}{6}$ | $\frac{\sqrt{5}}{24}(1+\sqrt{5})$ | 0 |
| s11 | $\frac{1}{12}$ | 0 | $\frac{1}{4}X^-$ | $-\frac{1}{4}X^+$ | $\frac{\sqrt{5}}{48}(\sqrt{5}+3)$ | 0 | $-\frac{\sqrt{5}}{6}$ | $\frac{\sqrt{5}}{24}(1+\sqrt{5})$ | 0 |
| s12 | $\frac{1}{12}$ | 0 | $-\frac{1}{4}X^-$ | $-\frac{1}{4}X^+$ | $\frac{\sqrt{5}}{48}(\sqrt{5}+3)$ | 0 | $\frac{\sqrt{5}}{6}$ | $\frac{\sqrt{5}}{24}(1+\sqrt{5})$ | 0 |

The constant auxiliary values $X^+$ and $X^-$ may be used to understand the formulas. These signals, whose directivity patterns may be described by substantially spherical harmonics, may be combined to achieve a desired directivity pattern of the overall microphone. A weighting of the individual signals converted to the B format may be used to achieve the desired pattern. These B format signals may also be referred to as combined signals.

In the example described above, the weighting factors of the zero order signal (omnidirectional signal) and the first-order signals (figure-eight signals) may be adjusted by a directivity factor. The directivity factor in some cases may yield an ambiguous result. Specifically, for certain values (for example, between 3 and 4) it is not apparent whether a directivity pattern is a cardioid and a hypercardioid, or a hypercardioid and a figure-eight. However, from the data required for calculation of the directivity factor the angle at which the sensitivity becomes minimal (e.g., the rejection angle) may be determined. In this system, a supercardioid may form the basis of a directivity factor of about 3.7 and not a directivity pattern, with a cancellation direction between about 90° and about 109°.

If spherically harmonic signals of higher order are also available, by adjusting the weighting factors, the distorting properties of the real capsule and a real structure may be accounted for. The "directivity factor" measurement instrument, may be adapted to the ambiguities with reference to a spatial angle since many more possibilities may be produced to achieve a specific directivity factor by a combination of three signals (zero, first, and second order). In one scenario, the directivity factor may be calculated separately for different spatial regions or angle regions. An integral may be carried out only over a predetermined spatial region. A comparison between these individual directivity factor components may be a clear assignment having the directivity patterns.

Consequently, any possible directivity pattern that may be formed as a combination of three signals (zero, first and second order) may be described by a set of (partial) directivity factor parameters. The task of the optimization algorithm is then to find the combination of weighting factors for these three signals that results from the measurement data of the real microphone structure of the desired set of directivity factor parameters. By this targeted optimization of linear combination parameters as a function of frequency, distortions may be minimized. An additional adjustment of the frequency response from the main direction of the synthesized microphone capsule is possible, without the need for additional calculation.

The synthesized directivity pattern may be electronically rotatable in all directions. There may be no shadowing effects in sound field microphones, since the microphone incidence directions all lie on a spherical surface and therefore do not mutually mask each other. The structure-borne noise components contributed by each of the individual real microphone capsules may be compensated for in the calculated omnidirectional signal. However, this does not apply for the figure-eight signals. After conclusion of the optimization process, the frequency response from the main direction (about 0°) is determined and the equalization filter with which the frequency response is adjusted from the main direction to the stipulated value is calculated. For better representation: starting from the formula K=W+k×X, for an almost pure figure-eight (only X), the weighting factor k may be made very large so that the level for K is also significantly increased and so that the about 0° frequency response is therefore altered. In a final step this may be remedied by equalization of the main direction frequency response according to a stipulated value.

By means of the adjusted and optimized weighting parameters, FIR filter coefficients may be calculated as in act 518 from FIG. 5. The FIR filter coefficients may influence the signal path (e.g., filters 6, 7, 8, and 9 from FIG. 5) of the B format signals so that the desired modeling of the microphone capsule may be achieved through a combination of signals and/or coefficients. With the expedient according to the system described above, novel possibilities for a microphone may be obtained. Modeling or imitation of the acoustic behavior of all ordinary microphones may be possible at a previously unattained level of quality with new acoustic properties.

Figure 9:
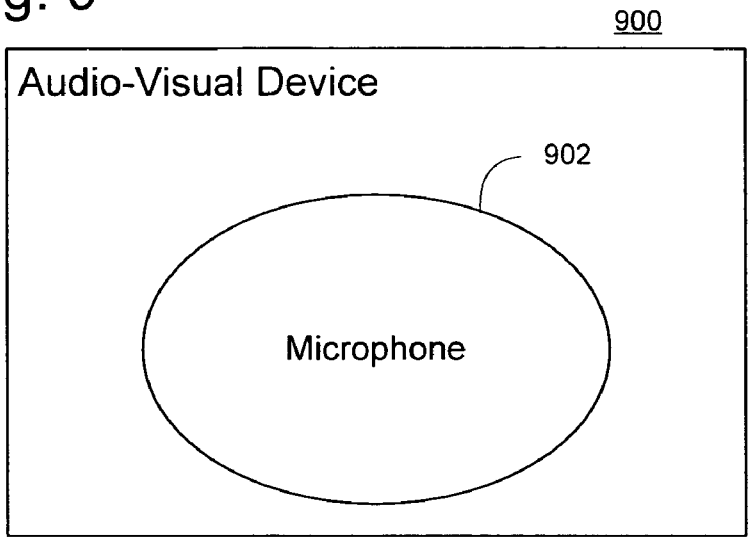
FIG. 9 is a diagram of a system with a microphone.
Figure 10:
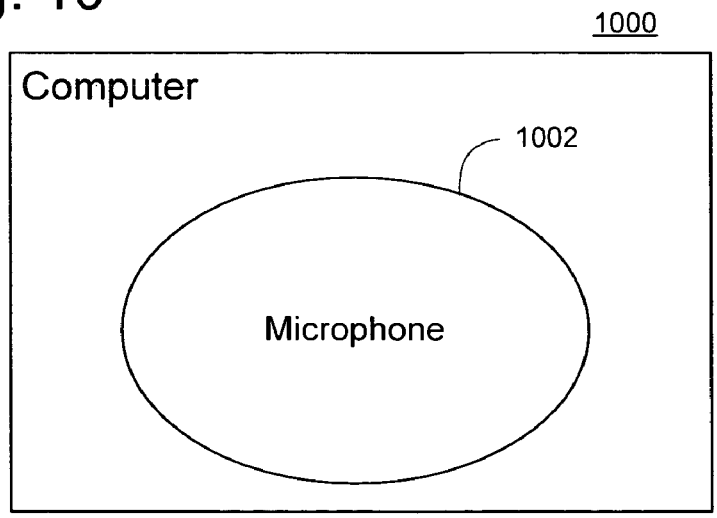
FIG. 10 is another diagram of a system with a microphone.

FIGS. 9 and 10 are diagrams illustrating the application of the systems described above. FIG. 9 shows an audio visual device 900 that utilizes a microphone 902. FIG. 10 shows a computer device 1000 that utilizes a microphone 1002. The microphones 902, 1002 may be as described above. The audio visual device 900 may be any device utilizing a microphone, such as a portable music player, a telephone, a voice recorder, or any device configured to convert sound into analog or digital signals. Likewise, computer device 1000 may be included as an audio visual device 900 and may also be a device configured to convert sound into analog or digital signals.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method for modeling a device that converts sound waves into analog and digital signals, the device including a plurality of capsules for generating respective capsule signals representing sound waves, the method comprising:

combining the capsule signals to generate a plurality of combined capsule signals, each having a specific directivity pattern;

synthesizing the combined capsule signals to generate a synthesized directivity pattern using a weighted value between selected combinations of combined capsule signals;

deriving a directivity factor for an overall signal resulting from the steps of combining and synthesizing;

comparing the derived directivity factor with a stipulated value that corresponds to a desired directivity pattern; and adjusting the weighted value based on the comparison of the derived directivity factor with the stipulated value and repeating the steps of synthesizing the combined capsule signals, deriving the directivity factor, and comparing the directivity factor until the derived directivity factor is substantially the same as the stipulated value within predetermined limits.

2. The method according to claim 1, where the plurality of capsule signals has characteristics of spherically harmonic functions.

3. The method according to claim 2, where the combined capsule signals has characteristics of spherically harmonic functions.

4. The method according to claim 1, where the specific directivity pattern comprises a cardioid, supercardioid, hypercardioid, omnidirectional, figure-eight, or a combination thereof.

5. The method according to claim 1, where the desired directivity pattern for the stipulated value is selected from a group consisting of: cardioid, supercardioid, hypercardioid, omnidirectional, and figure-eight, or a combination thereof.

6. The method according to claim 1, where the step of deriving a directivity factor comprises measuring the sensitivity of the device from different spatial directions.

7. The method according to claim 1, where the step of deriving a directivity factor further comprises measuring the sensitivity of the device through different frequencies of an input.

8. The method according to claim 1, where the device comprises a sound field microphone or a B format microphone.

9. The method according to claim 8, where the device comprises four capsules.

10. A system comprising:

a microphone including a plurality of capsules, for generating respective capsule signals representing sound waves;

a computer-readable medium for storing instructions thereon; and at least one processor cooperatively associated with the microphone for executing instructions stored in the computer-readable medium to perform the steps of:

combining the capsule signals to generate a plurality of combined capsule signals, each having a specific directivity pattern;

synthesizing the combined capsule signals to generate a synthesized directivity pattern using a weighted value between selected combinations of combined capsule signals;

comparing the derived directivity factor with a stipulated value that corresponds to a desired directivity pattern; and adjusting the weighted value based on the comparison of the derived directivity factor with the stipulated value and repeating the steps of synthesizing the combined capsule signals, deriving the directivity factor, and comparing the derived directivity factor until the derived directivity factor is substantially the same as the stipulated value within predetermined limits.

11. The system of claim 10, further comprising at least one filter configured to generate a respective transformed signal by selectively passing elements of the capsule signals, where the at least one filter performs a weighted adjustment of the transformed signals.

12. The system of claim 10, where the capsule signals has characteristics of spherically harmonic functions.

13. The system of claim 10, where the microphone comprises a sound field microphone.

14. The system of claim 13, where the microphone comprises a second-order sound field.

15. The system of claim 10, where the microphone comprises four capsules.

16. The system of claim 10, where the microphone includes twelve capsules arranged in the form of a dodecahedron.

17. The system of claim 10, where the directivity patterns comprise a substantially cardioid, supercardioid, hypercardioid, omidirectional, figure-eight shape, or a combination thereof.

18. The system of claim 10, where the weighted adjustment of the capsule signals adjusts the directivity factor toward the stipulated value.

19. The method of claim 1 where the device includes a first capsule for receiving a signal A, a second capsule for receiving a signal B, a third capsule for receiving a signal C, and a fourth capsule for receiving a signal D, the step of combining the capsule signals includes:

transforming the capsule signals A, B, C, D to B format signals W, X, Y, Z using the following:

$$W=\tfrac{1}{2}(A+B+C+D)$$

$$X=\tfrac{1}{2}(A+B-C-D)$$

$$Y=\tfrac{1}{2}(-A+B+C-D)$$

$$Z=\tfrac{1}{2}(-A+B-C+D).$$

20. The method of claim 19 where the step of synthesizing the desired directivity pattern includes applying the weighted value to at least one selected B format signal.

21. The method of claim 19 where the capsules of the device each have a membrane, where the device is a spherical microphone having the four capsules oriented so that the membranes of the capsules are on planes parallel to corresponding faces of a tetrahedron and orthogonal to a corresponding one of the x, y, and z dimensional axes, and where:

the signal W follows an omnidirectional directivity pattern;

the signal X follows a figure of eight directivity pattern along the x axis;

the signal Y follows a figure of eight directivity pattern along the y axis; and the signal Z follows a figure of eight directivity pattern along the z axis.

22. The method of claim 1 where the step of synthesizing the desired directivity pattern includes:

forming linear combinations of the combined capsule signals using the weighted value on selected combined capsule signals.

23. The method of claim 1 further comprising:

generating filter coefficients for finite impulse response ("FIR") filters to filter the combined signals based on the weighted value.

24. The system of claim 10 where the device includes a first capsule for receiving a signal A, a second capsule for receiving a signal B, a third capsule for receiving a signal C, and a fourth capsule for receiving a signal D, the step of combining the capsule signals includes:

transforming the capsule signals A, B, C, D to B format signals W, X, Y, Z using the following:

$$W=\tfrac{1}{2}(A+B+C+D)$$

$$X=\tfrac{1}{2}(A+B-C-D)$$

$$Y=\tfrac{1}{2}(-A+B+C-D)$$

$$Z=\tfrac{1}{2}(-A+B-C+D).$$

25. The system of claim 24 where the step of synthesizing the desired directivity pattern includes applying the weighted value to at least one selected B format signal.

26. The system of claim 24 where the capsules of the device each have a membrane, where the device is a spherical microphone having the four capsules oriented so that the membranes of the capsules are on planes parallel to corresponding faces of a tetrahedron and orthogonal to a corresponding one of the x, y, and z dimensional axes, and where:

the signal W follows an omnidirectional directivity pattern;

the signal X follows a figure of eight directivity pattern, along the x axis;

the signal Y follows a figure of eight directivity pattern along the y axis; and the signal Z follows a figure of eight directivity pattern along the z axis.

27. The system of claim 10 where the step of synthesizing the desired directivity pattern includes:

forming linear combinations of the combined capsule signals using the weighted value on selected combined capsule signals.

28. The system of claim 10 further comprising:

generating filter coefficients for finite impulse response ("FIR") filters to filter the combined signals based on the weighted value.

* * * * *

UNITED STATES PATENT AND TRADEMARK OFFICE

CERTIFICATE OF CORRECTION

PATENT NO. : 8,284,952 B2
APPLICATION NO. : 11/472801
DATED : October 9, 2012
INVENTOR(S) : Friedrich Reining et al.

It is certified that error appears in the above-identified patent and that said Letters Patent is hereby corrected as shown below:

Column 6
Line 67, please delete "W(r, φ, φ)" and insert -- W(r, φ, θ) --

Column 12
Line 20, please delete "omidirectional" and insert -- omnidirectional --

Signed and Sealed this
Eighteenth Day of December, 2012

David J. Kappos

David J. Kappos
*Director of the United States Patent and Trademark Office*